US007586459B2

(12) United States Patent
Noro et al.

(10) Patent No.: US 7,586,459 B2
(45) Date of Patent: Sep. 8, 2009

(54) ANTENNA APPARATUS

(75) Inventors: Junichi Noro, Akita (JP); Kyuichi Sato, Oga (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 11/975,933

(22) Filed: Oct. 23, 2007

(65) Prior Publication Data

US 2008/0100528 A1 May 1, 2008

(30) Foreign Application Priority Data

Oct. 26, 2006 (JP) ..... 2006-291339

(51) Int. Cl.
*H01Q 1/42* (2006.01)

(52) U.S. Cl. ..... 343/872; 343/711

(58) Field of Classification Search ..... 343/872, 343/711, 713, 700 MS, 873
See application file for complete search history.

(56) References Cited

U.S. PATENT DOCUMENTS 5,585,809 A * 12/1996 Yajima et al. ..... 343/713
6,016,128 A * 1/2000 Imamura et al. ..... 343/741
6,023,245 A * 2/2000 Gomez et al. ..... 343/725
6,683,570 B2 * 1/2004 Skladany et al. ..... 343/700 MS
7,151,503 B2 * 12/2006 Noro et al. ..... 343/872
7,283,100 B2 * 10/2007 Thompson et al. ..... 343/713
7,339,538 B2 * 3/2008 Yoneya et al. ..... 343/713
2006/0262018 A1 * 11/2006 Mikami et al. ..... 343/713

FOREIGN PATENT DOCUMENTS

JP 11-074716 A 3/1999

* cited by examiner

*Primary Examiner*—Hoang V Nguyen
(74) *Attorney, Agent, or Firm*—Frishauf, Holtz, Goodman & Chick, P.C.

(57) ABSTRACT

Disclosed is an antenna apparatus comprising: an antenna module comprising a ground plate and an antenna element having a metal plate disposed at a predetermined distance from the ground plate; and an antenna cover to cover the antenna module, wherein the antenna cover includes an antenna holding section to hold the antenna module, and a mounting section which is integrally formed on the antenna holding section to mount the antenna cover on external equipment.

4 Claims, 6 Drawing Sheets

ANTENNA APPARATUS

BACKGROUND OF THE INVENTION

1. Field of the Invention

The present invention relates to an antenna apparatus, and more particularly, to an antenna apparatus which accommodates a small flat antenna module and which is mounted on external equipment.

2. Description of Related Art

In recent years, there are small flat antennas which have been developed as antennas used for GPS car navigation systems, portable navigation systems, satellite wave receivers and the like.

The differences occur in performance of an antenna depending upon a mounting position and a mounting angle. Therefore, in order to operate an antenna normally, the mounting mechanism thereof is important. Especially in the case of an antenna used for a vehicular GPS system, it is necessary to dispose the antenna horizontally in a vehicle. Thus, when a vehicular GPS system is configured, the mounting mechanism of a GPS antenna is important.

In this regard, conventionally, a unit module in which an antenna (antenna module) and a high frequency circuit substrate which performs processings such as removing the noise from received radio waves and amplifying the waves combined together and unitized, is accommodated in a resin case also comprising a top cover and a bottom cover. Generally, the bottom cover is fixed to a metal mounting bracket, and this metal bracket is mounted on a dashboard or the like of a vehicle.

However, when the case comprises the top cover and the bottom cover and the bottom cover side is fixed to the metal bracket, there is a problem that the number of parts is increased and thus, the number of assembling steps is increased. Therefore, the apparatus cost is increased.

Hence, the antenna apparatus is devised so that a unitized GPS antenna is accommodated in a cover member comprising a GPS antenna container, a mounting section to be mounted on the metal bracket is provided, and the cover member side is fixed to the metal bracket. Therefore, the antenna is mounted (see patent Japanese Patent Application Laid-open Publication No. 11-74716 for example).

However, since the metal bracket does not have flexibility, in order to mount the antenna horizontally, it is necessary to carry out adjustment to previously bend the antenna in accordance with a shape of a portion to be mounted on the antenna, or to sandwich another member between the cover and the metal bracket on the mounting side. Further, in a case of the metal bracket, when a screw hole for mounting the metal bracket on a vehicle body is formed, the screw hole can only be formed vertically, and the freedom degree in design of the metal bracket is low. Therefore, there is a problem that a plurality of kinds of metal brackets are required to be prepared in accordance with a shape of the receiving side, and the development cost is increased.

SUMMARY OF THE INVENTION

Hence, the present invention has been accomplished to solve such problems, and it is an object of the invention to provide an antenna which can easily be mounted in accordance with shapes of various mounting members.

According to a first aspect of the present invention, there is provided an antenna apparatus comprising:

an antenna module comprising a ground plate and an antenna element having a metal plate disposed at a predetermined distance from the ground plate; and an antenna cover to cover the antenna module, wherein the antenna cover includes an antenna holding section to hold the antenna module, and a mounting section which is integrally formed on the antenna holding section to mount the antenna cover on external equipment.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

An embodiment of an antenna apparatus according to an embodiment of the present invention will be explained with reference to FIGS. 1 to 7. The scope of the invention is not limited to illustrated examples.

The antenna apparatus of the embodiment of the present invention is mounted on a dashboard of a vehicle for example, and comprises an antenna module used for receiving radio wave for a GPS (Global Positioning System) or a satellite radio.

Figure 1:
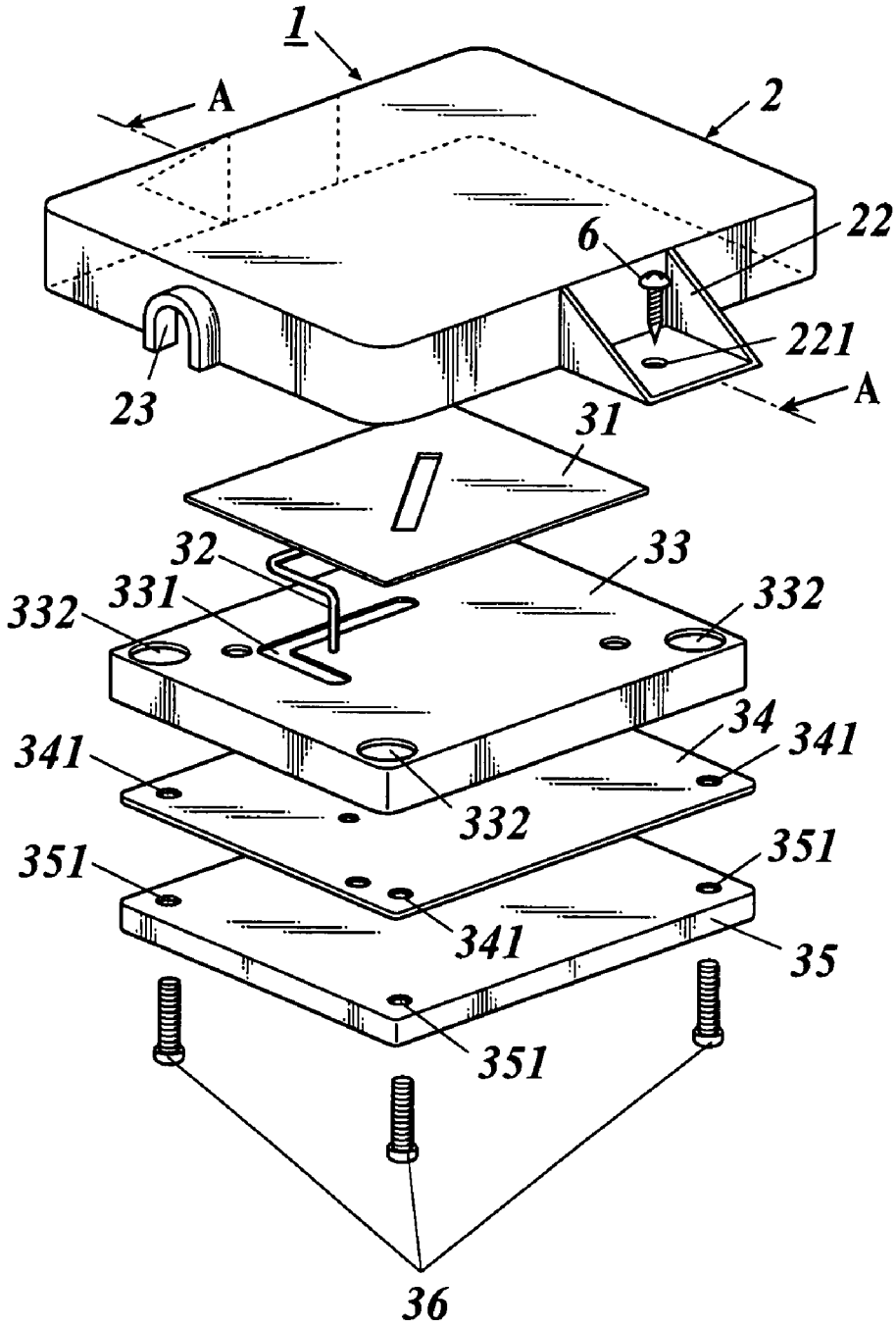
FIG. 1 is an exploded perspective view of an antenna apparatus of an embodiment of the present invention.

FIG. 1 is an exploded perspective view of the antenna apparatus of the embodiment. As shown in FIG. 1, in this embodiment, the antenna apparatus 1 comprises an antenna cover 2 which can be mounted on external equipment 5 (see FIG. 3 and the like) such as a dashboard of a vehicle, and an antenna module 3 covered by the antenna cover 2.

As shown in FIG. 1, in the embodiment, the antenna module 3 includes an antenna element 31, an antenna probe 32, a probe holder 33, a ground plate 34 and a bottom plate 35 which supports these members.

Although the antenna module does not comprise an LNA (Low Noise Amplifier) in this embodiment, an antenna module comprising the LNA can also be applied.

The ground plate 34 is a substantially quadrangular metal plate member. The antenna element 31 is also a substantially quadrangular metal plate member, and is opposed to the ground plate 34 at a predetermined distance therefrom.

The antenna probe 32 is made of metal, and is held so that the antenna probe is disposed between the ground plate 34 and the antenna element 31 by the probe holder 33.

The probe holder 33 is a substantially cubic member made of resin such as ABS, ASA and PC. The probe holder 33 has an area equal to or greater than opposed areas between the ground plate 34 and the antenna element 31 so as to occupy substantially the entire space between the ground plate 34 and the antenna element 31.

A substantially L-shaped groove 331 is formed in a ceiling (upper surface in FIG. 1) of the probe holder 33. The antenna probe 32 is inserted into the groove 331 so that the antenna probe 32 is reliably held at a predetermined position.

In this embodiment, areas of the ground plate 34 and the antenna element 31 of the antenna module 3 are smaller than those of a conventional antenna module. When the ground plate 34 and the antenna element 31 are reduced in size, the capacitance of the antenna module 3 is lowered, and there is a possibility that the antenna apparatus 1 can not exhibit sufficient gains. However, in the antenna module 3, the probe holder 33 which is a resin member is disposed between the ground plate 34 and the antenna element 31. Since resin has higher specific inductive capacity than air, it is possible to secure sufficient capacitance and to exhibit high gains.

The bottom plate 35 is a substantially quadrangular plate member having substantially the same area as an area of each of the ground plate 34 and the antenna element 31. The bottom plate 35 is made of hard rubber for example. The bottom plate 35 supports the ground plate 34 and the antenna element 31 from lower direction of the antenna apparatus 1 (lower direction in FIG. 1). The bottom plate 35 protects the ground plate 34 and the antenna element 31 from external stimuli.

In this embodiment, screw holes 351 and 341 are formed in the bottom plate 35 and the ground plate 34 at locations corresponding to corner portions thereof. Screws 36 are inserted into the screw holes 351 and 341. Inserting sections 332 such as screw holes and grooves are formed in the probe holder 33 at locations corresponding to corner portions thereof. The screws 36 are inserted through the inserting sections 332. Bosses 212 forming later-described antenna fixing screw holes 211 of the antenna cover 2 are inserted through the inserting sections 332. The bosses 212 of the antenna cover 2 are inserted through the inserting sections 332, and the probe holder 33 is sandwiched between the antenna element 31 and the ground plate 34 and fixed therebetween. The shapes and the like of the inserting sections 332 are not limited to those illustrated in the drawings only if the bosses 212 can be inserted through the inserting sections 332.

A coaxial cable 4 is connected to the antenna module 3 such that one end of the coaxial cable 4 is connected to the antenna element 31.

Figure 2A:
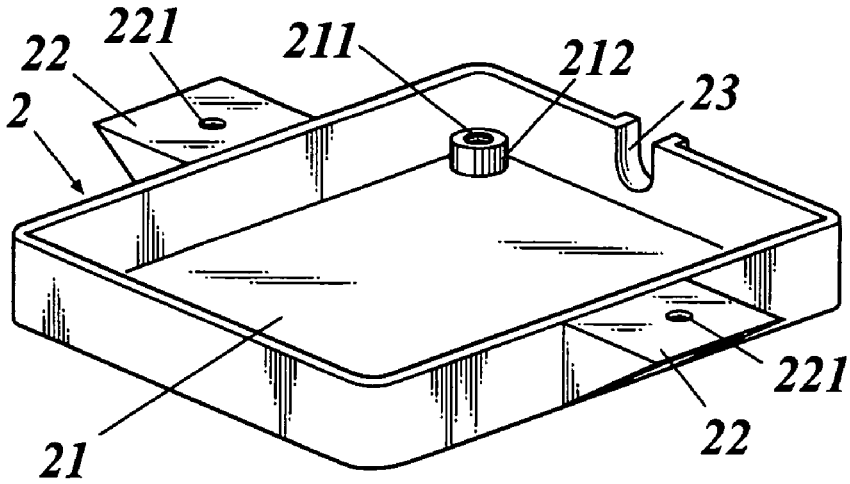
FIG. 2A is a perspective view of an antenna cover applied to the antenna apparatus shown in FIG. 1.

Next, the antenna cover 2 will be explained with reference to FIGS. 2A and 2B. FIG. 2A is a perspective view of the antenna cover 2, and FIG. 2B is a plan view of the antenna cover 2 shown in FIG. 2A.

Figure 2B:
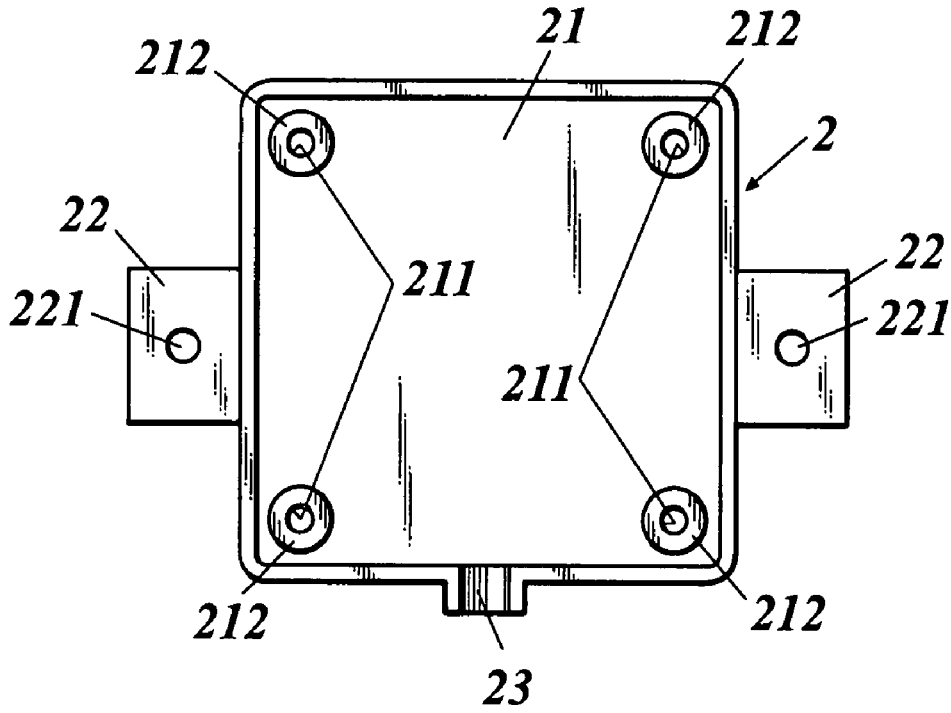
FIG. 2B is a plan view of the antenna cover shown in FIG. 2A.

As shown in FIGS. 2A and 2B, the antenna cover 2 is formed into a substantially box-like shape. An antenna holding section 21 is provided inside the antenna cover 2. The antenna holding section 21 is a space for holding the antenna module 3, and is slightly greater than the antenna module 3 in size.

The antenna cover 2 is provided with mounting sections 22 projecting outward from opposite sidewalls of the antenna holding section 21. The mounting sections 22 are provided for mounting the antenna cover 2 on the external equipment 5.

The antenna cover 2 made of resin such as ABS, ASA and PC. The antenna holding section 21 and the mounting sections 22 are integrally molded.

In this embodiment, the antenna holding section 21 of the antenna cover 2 is formed at its corner portions with bosses 212 through which the inserting sections 332 are inserted. The bosses 212 are formed in the corner portions of the antenna holding section 21 at locations corresponding to the inserting sections 332 such as the screw holes and grooves provided in the probe holder 33.

Antenna fixing screw holes 211 are formed in substantially central portions of the bosses 212 at locations corresponding to the screw holes 351 and 341 provided in the bottom plate 35 and the ground plate 34.

As shown in FIG. 1, in this embodiment, the antenna module 3 is mounted in the antenna cover 2 in a following manner. In a state that the antenna element 31, the probe holder 33 which holds the antenna probe 32, the ground plate 34 and the bottom plate 35 are laminated on one another, the bosses 212 of the antenna cover 2 are inserted through the inserting sections 332 of the probe holder 33, the screws 36 are inserted from the screw holes 351 formed in the bottom plate 35, and are inserted through the screw holes 341 formed in the ground plate 34, and thus fixed to the antenna fixing screw holes 211 of the antenna holding section 21.

The mounting sections 22 are formed with apparatus fixing screw holes 221 for screwing the antenna cover 2 to the external equipment 5. The antenna apparatus 1 is fixed to the external equipment 5 by fixing the screws 6 (see FIG. 4 and the like) inserted from the screw holes 511 (see FIG. 4 and the like) provided on the side of the external equipment 5 to the apparatus fixing screw holes 221.

Further, a table notch 23 is formed in a sidewall of the antenna cover 2 at a location where the coaxial cable 4 exists when the antenna module 3 is held in the antenna holding section 21.

Figure 3:
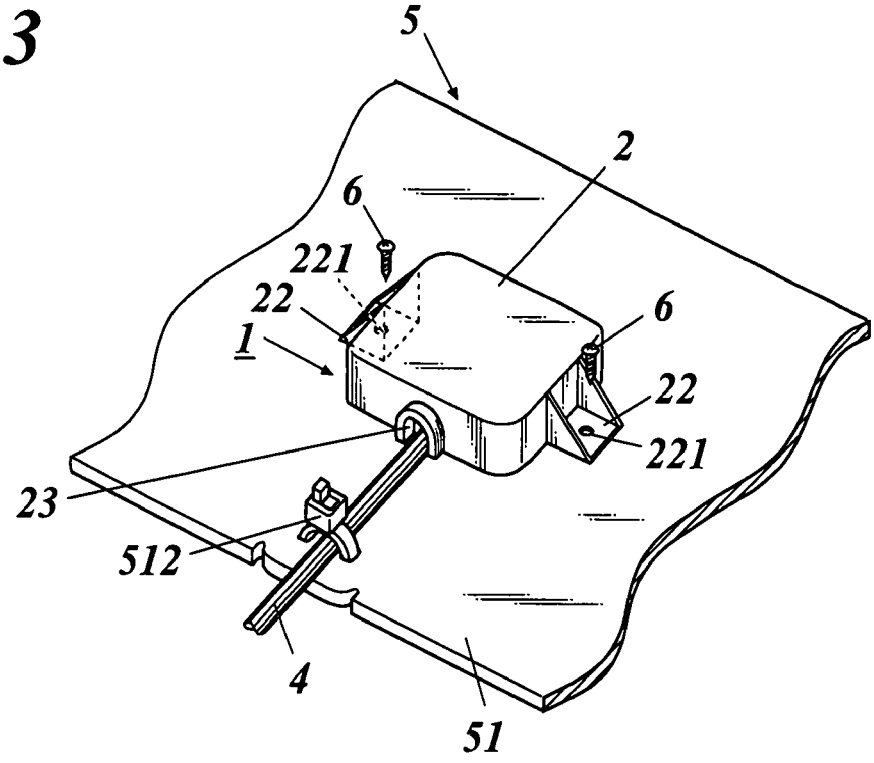
FIG. 3 is a perspective view showing the antenna apparatus of the embodiment mounted on external equipment.
Figure 4:
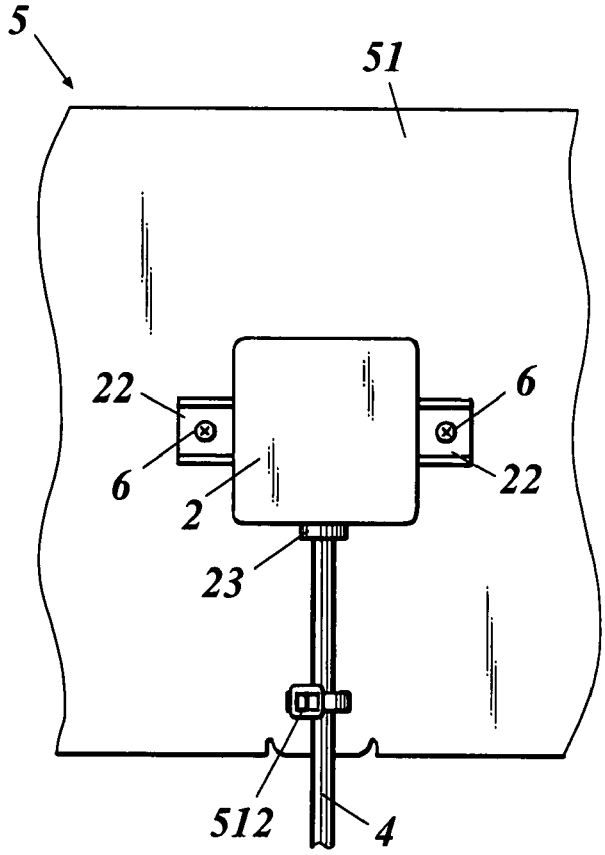
FIG. 4 is a plan view of the antenna apparatus shown in FIG. 3, which is mounted on the external equipment.
Figure 5:
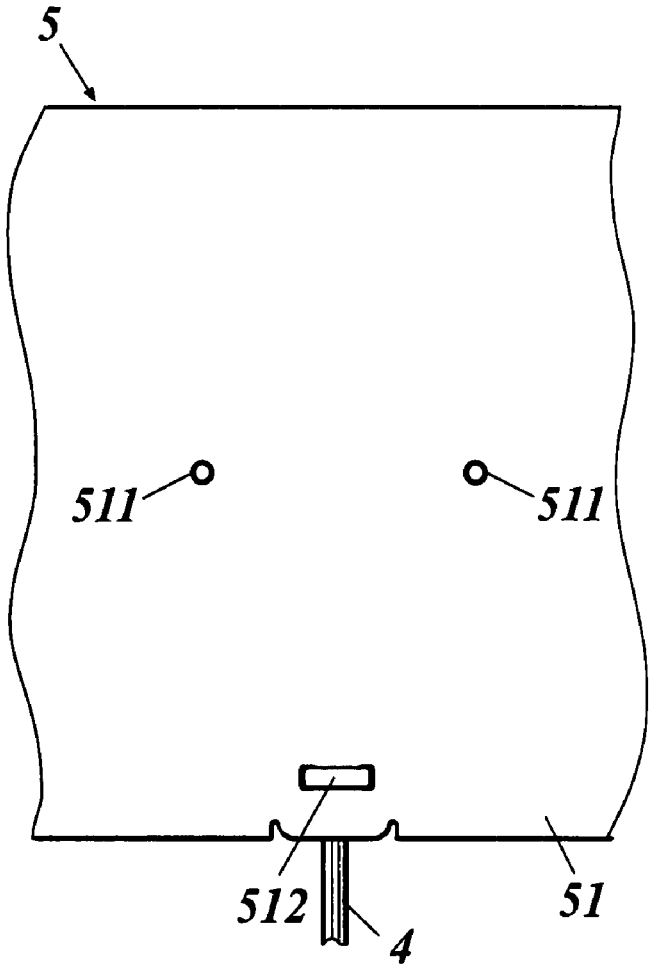
FIG. 5 is a bottom view of the antenna apparatus shown in FIG. 3, which is mounted on the external equipment.
Figure 6:
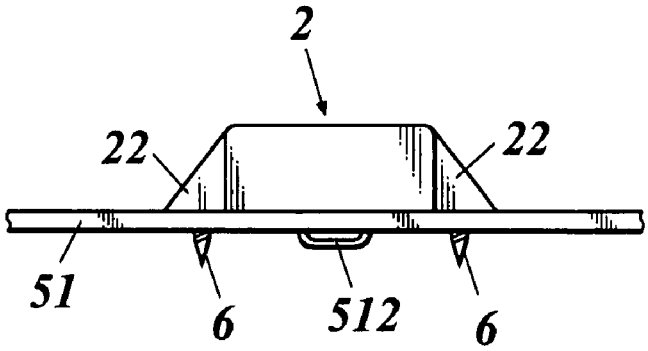
FIG. 6 is a rear view of the antenna apparatus shown in FIG. 3, which is mounted on the external equipment.

FIG. 3 is a perspective view showing the antenna apparatus 1 of the embodiment mounted on the external equipment 5 such as a mounting-side bracket or the like. FIG. 4 is a plan view of the antenna apparatus 1 shown in FIG. 3, which is mounted on the external equipment 5. FIG. 5 is a bottom view of the antenna apparatus 1, and FIG. 6 is a rear view thereof. In the embodiment, the antenna apparatus 1 is fixed to the external equipment 5 and mounted on a predetermined position in a vehicle. In this embodiment, the antenna apparatus 1 is mounted in the dashboard of a vehicle for example, and the position where the antenna apparatus 1 is mounted is not limited to this.

As shown in FIGS. 3 to 6, the external equipment 5 is provided with an antenna fixing section 51. The external equipment 5 is the equipment on which the antenna apparatus provided in a dashboard of a vehicle is mounted and fixed.

Screw holes 511 are formed in the antenna fixing section 51 at locations corresponding to locations where the apparatus fixing screw holes 221 of the antenna apparatus 1 are provided. When the antenna apparatus 1 is fixed, the screws 6 are inserted through the screw holes 511. In the embodiment, the two mounting sections 22 provided on the antenna cover 2 are secured to the antenna fixing section 51 by screws, thereby fixing the antenna apparatus 1 to the external equipment 5. The screw holes 511 are provided in accordance with the screwing positions.

The antenna fixing section 51 is provided with a cable fixing member 512 for fixing the coaxial cable 4 connected to the antenna module 3.

The positions of the screw holes 511 and the cable fixing member 512 are determined in accordance with a size and a shape of the antenna apparatus 1 fixed to the antenna fixing section 51 and a position where the coaxial cable 4 is mounted, and such positions are not limited to the illustrated example.

Next, the application of the embodiment will be explained with reference to FIG. 7.

Figure 7:
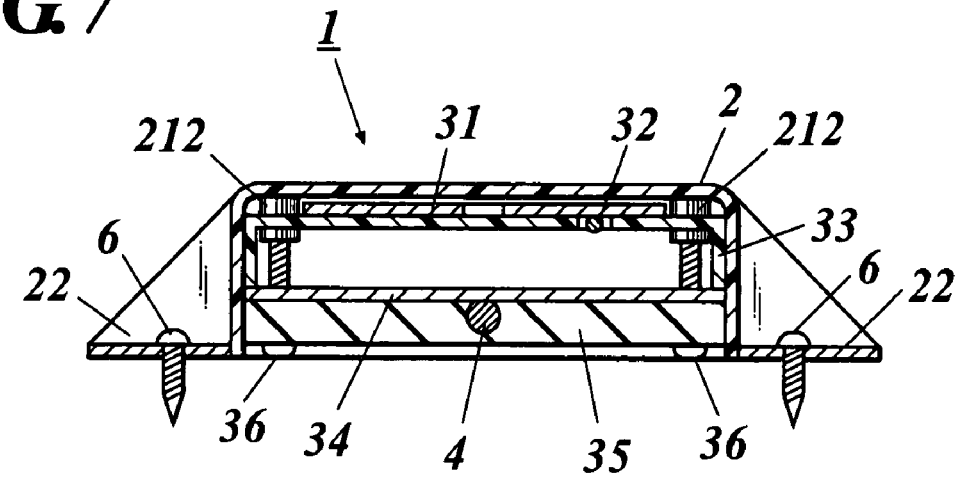
FIG. 7 is a sectional view of the antenna apparatus shown in FIG. 1, which is taken along the line A-A.

FIG. 7 is a sectional view of the antenna apparatus 1. According to the antenna apparatus 1 of the embodiment, the antenna element 31, the antenna probe 32, the probe holder 33, the ground plate 34 and the bottom plate 35 are laminated on one another in this order, and the coaxial cable 4 is connected to the antenna element 31. The antenna module 3 is accommodated in the antenna holding section 21 of the antenna cover 2 such that the coaxial cable 4 comes to a position where the table notch 23 is provided.

As shown in FIG. 7, when the antenna module 3 is accommodated in the antenna holding section 21, the bosses 212 of the antenna cover 2 are inserted through the inserting sections 332 formed in the probe holder 33. Further, the screws 36 are inserted from the screw holes 351 of the bottom plate 35, inserted through the screw holes 341 formed in the ground plate 34 and the inserting sections 332 of the probe holder 33. The screws 36 are penetrated through the antenna fixing screw holes 211 of the antenna holding section 21 and fixed thereto, thus antenna module 3 is mounted in the antenna cover 2.

When the antenna apparatus 1 is mounted on the external equipment 5, the antenna apparatus 1 is disposed such that the positions of the apparatus fixing screw holes 221 formed in the mounting section 22 match with positions of the screw holes 511 provided in the antenna fixing section 51 of the external equipment 5. The screws 6 are inserted from the apparatus fixing screw holes 221 of the mounting section 22. The screws 6 are fixed to the screw holes 511 of the external equipment 5, and the coaxial cable 4 is fixed by the cable fixing member 512 provided on the antenna fixing section 51. With this, the coaxial cable 4 is horizontally fixed with respect to the external equipment 5.

As described above, according to the embodiment, the mounting sections 22 for mounting the antenna apparatus 1 on the external equipment 5 are provided on the antenna cover 2 which covers the antenna module 3. Therefore, the antenna apparatus 1 can easily be fixed to the external equipment 5 without using a separate mounting member. With this, the producing procedure of the antenna apparatus 1 can be simplified, the number of parts can be reduced. Thus, the apparatus cost can be reduced.

The apparatus fixing screw holes 221 for securing the antenna apparatus 1 to the external equipment 5 by screws are provided in the mounting sections 22 of the antenna cover 2, and the antenna cover 2 which holds the antenna module 3 is fixed to the external equipment 5 by screwing the mounting sections 22. Thus, the antenna apparatus 1 can easily and reliably be fixed to the external equipment 5.

Since the antenna cover 2 is made of resin, the antenna cover 2 can deform in accordance with the shape of the external equipment 5 which is the mounting side, and shapes of the apparatus fixing screw holes 221 can be worked easily.

Since the antenna apparatus comprises the bottom plate 35 made of hard rubber, the antenna element 31 and the ground plate 34 are protected and the hermetic degree of the antenna apparatus 1 is high.

The antenna module 3 is mounted in the antenna cover 2 in such a manner that the bosses 212 of the antenna cover 2 are inserted through the inserting sections 332 of the probe holder 33. The screws 36 are inserted from the screw holes 351 of the bottom plate 35 and through the screw holes 341 formed in the ground plate 34, and penetrated through the antenna fixing screw holes 211 of the antenna holding section 21 and fixed thereto. Therefore, the antenna module 3 is easily and reliably fixed to the antenna cover 2 with one screwing operation, the producing procedure of the antenna apparatus 1 can be simplified. Thus, the number of parts can be reduced and the apparatus cost can be reduced.

In this embodiment, the mounting sections 22 comprising the apparatus fixing screw holes 221 are provided at two locations such as to project outward from two sides of the sidewalls of the antenna holding section 21, and the antenna apparatus 1 and the external equipment 5 are secured to each other by two screws at two locations. However, the positions of the mounting sections 22 and the number of the mounting sections 22 are not especially limited. It is only necessary to provide the mounting sections 22 at substantially symmetric positions of the antenna cover 2 so that the antenna cover 2 can be mounted horizontally with respect to the external equipment 5. For example, the mounting section 22 my be provided on each side of the sidewalls of the antenna cover 2, and the antenna apparatus 1 and the external equipment 5 may be secured to each other with four screws at four locations.

In the embodiment, the screws 6 are inserted from the mounting sections 22 of the antenna apparatus 1 and fixed to the screw holes 511 of the external equipment 5. The screwing direction is not limited to this, and the screws 6 may be inserted from the side of the external equipment 5, and the external equipment 5 and the antenna apparatus 1 may be secured to each other through screws.

The directions in which the apparatus fixing screw holes 221 are formed are not limited to those described in this embodiment.

For example, directions of the screw holes when the screws 6 are inserted from the side of the mounting sections 22 of the antenna apparatus 1 and fixed to the screw holes 511 of the external equipment 5 will be explained with reference to FIGS. 8 and 9.

Figure 8:
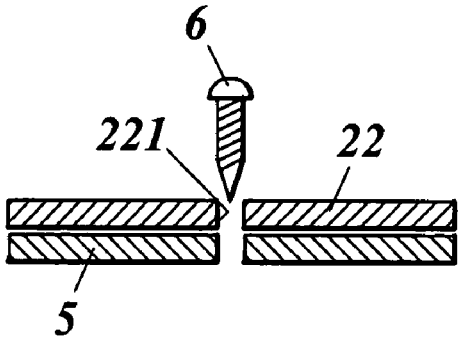
FIG. 8 is a schematic sectional view of an essential portion of one example of an apparatus fixing screw hole.
Figure 9:
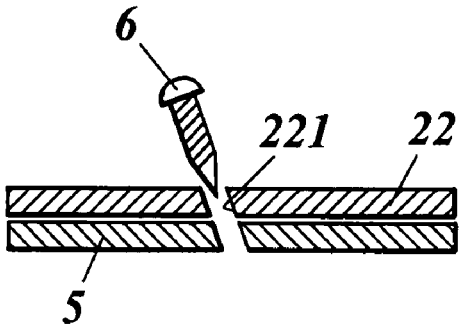
FIG. 9 is a schematic sectional view of an essential portion of one modification example of the apparatus fixing screw hole shown in FIG. 8.

As shown in FIG. 8, in the embodiment, the apparatus fixing screw holes 221 are formed in a direction perpendicular with respect to the antenna element 31 or the like, and the screw 6 is inserted from the perpendicular direction. Alternatively for example, as shown in FIG. 9, the apparatus fixing screw holes 221 may be formed obliquely, and the screw 6 may be inserted from the oblique direction with respect to the external equipment 5 and fixed.

In the embodiment, since the antenna cover 2 is made of resin, it is easy to obliquely form the apparatus fixing screw holes 221. When the apparatus fixing screw holes 221 is obliquely formed in this manner, even when the mounting section of the external equipment 5 is inclined, the antenna apparatus 1 can easily be fixed horizontally without changing the antenna cover 2 itself in design, but only by forming the apparatus fixing screw holes 221 to suit this inclination.

Although the antenna module 3 is the flat loop antenna in this embodiment, kinds of the antenna module 3 are not especially limited.

Figure 10:
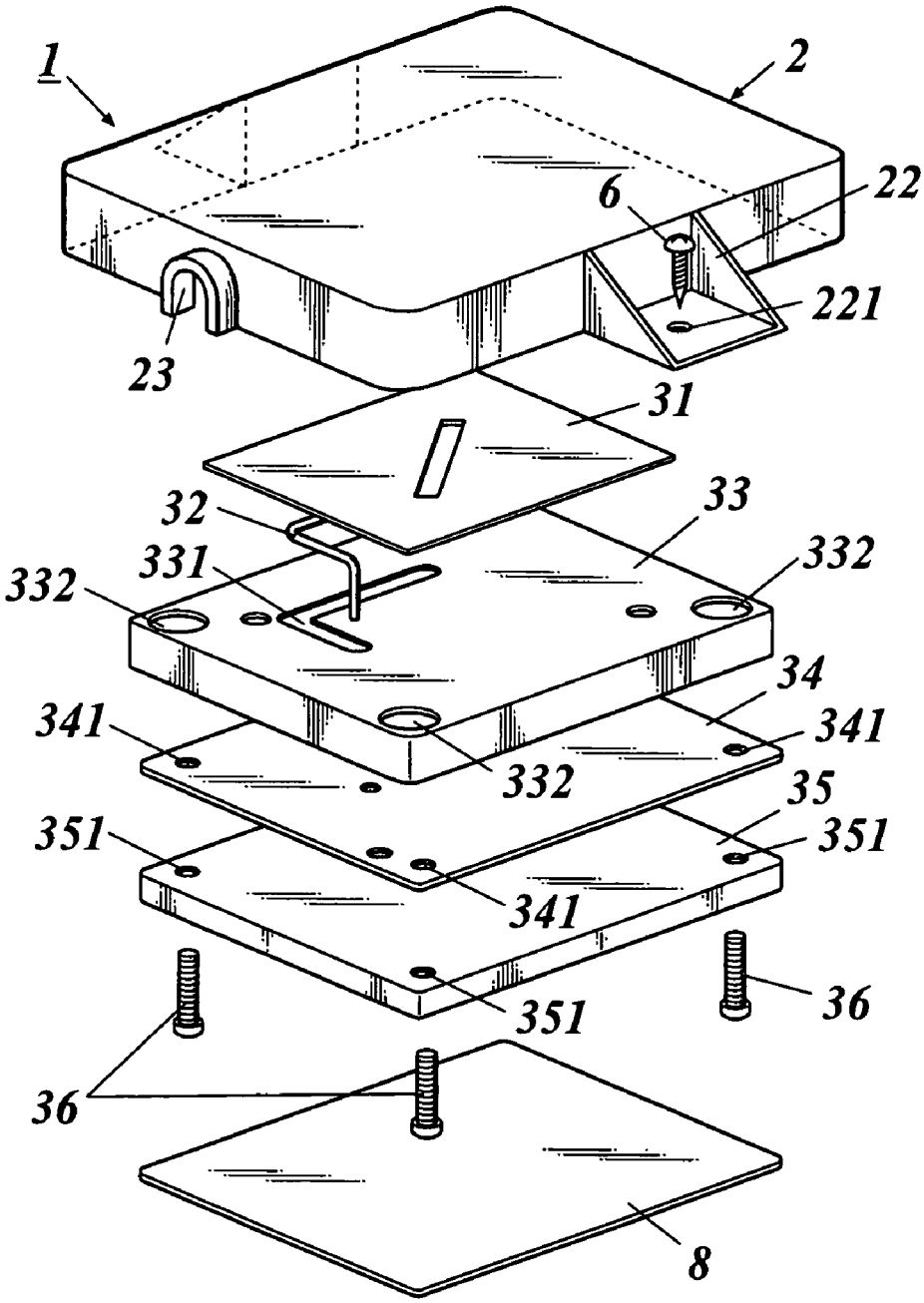
FIG. 10 is an exploded perspective view showing one modification example of the antenna apparatus shown in FIG. 1.

In the embodiment, the antenna module 3 comprises the antenna element 31, the antenna probe 32, the probe holder 33, the ground plate 34 and the bottom plate 35. However, the structure of the antenna module 3 is not limited to the illustrated example. As shown in FIG. 10 for example, a bottom metal plate 8 may further be provided on the side of a surface of the bottom plate 35 which is not opposed to the ground plate 34. In this case, it is possible to establish a ground more reliably by this metal plate.

According to a first aspect of the preferred embodiments of the present invention, there is provided an antenna apparatus comprising:

an antenna module comprising a ground plate and an antenna element having a metal plate disposed at a predetermined distance from the ground plate; and an antenna cover to cover the antenna module, wherein the antenna cover includes an antenna holding section to hold the antenna module, and a mounting section which is integrally formed on the antenna holding section to mount the antenna cover on external equipment.

The antenna apparatus is mounted on the external equipment by a mounting section provided on the side of the antenna cover.

Since the antenna cover covering the antenna module is provided with the mounting section to be mounted on the external equipment, it is possible to easily fix the antenna apparatus to the mounting side of the external equipment without using a separate mounting member.

Preferably, in the mounting section, a screw hole for screwing the mounting section to the external equipment, is formed, and the antenna cover is fixed to the external equipment by screwing the mounting section.

The mounting section and the external equipment are secured by a screw, thereby fixing the antenna cover to the external equipment.

The antenna cover which holds the antenna module is fixed to the external equipment by screwing the mounting section. Therefore, it is possible to easily fix the antenna apparatus reliably to the external equipment.

Preferably, the antenna cover is made of resin.

The antenna module is covered with a resin antenna cover.

Since the antenna cover is made of resin, the antenna cover can deform in accordance with a shape of the external equipment, and it is easier to adjust an angle or the like forming the screw hole as compared with a metal plate, and various adjustments can be carried out in accordance with shapes of various external equipment which is to be mounted, such as forming a screw hole for screwing the antenna to the external equipment obliquely.

Preferably, the antenna module comprises a bottom plate to support the antenna element and the ground plate, and a screw which passes through the bottom plate and the ground plate to screw the antenna module and the antenna cover.

The antenna module and the antenna cover are secured by a screw which passes through the bottom plate and the ground plate.

The bottom plate which supports the antenna element and the ground plate is provided, and the antenna module and the antenna cover are secured by the screw which passes through the ground plate and the bottom plate. Therefore, the antenna element and the ground plate are protected by the bottom plate and the antenna apparatus has an excellent hermetic degree.

Preferably, the bottom plate is made of hard rubber.

The antenna element and a ground plate are supported by a bottom plate which is made of hard rubber.

The bottom plate supporting the antenna element and the ground plate is made of hard rubber which is more flexible than the metal plate. Therefore, the antenna can easily be mounted in accordance with shapes of various external equipment.

The entire disclosure of Japanese Patent Application No. 2006-291339 filed on Oct. 26, 2006 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An antenna apparatus comprising:

an antenna module comprising a ground plate and an antenna element having a metal plate disposed at a predetermined distance from the ground plate; and an antenna cover to cover the antenna module, wherein the antenna cover includes an antenna holding section to hold the antenna module, and a mounting section in which a screw hole is formed for mounting the antenna cover on external equipment, and wherein the antenna holding section and the mounting section are integrally molded.

2. The antenna apparatus according to claim 1, wherein the antenna cover is made of resin.

3. An antenna apparatus comprising:

an antenna module comprising a ground plate and an antenna element having a metal plate disposed at a predetermined distance from the ground plate; and an antenna cover to cover the antenna module, wherein the antenna cover includes an antenna holding section to hold the antenna module, and a mounting section for mounting the antenna cover on external equipment, wherein the antenna holding section and the mounting section are integrally molded, and wherein the antenna module comprises a bottom plate to support the antenna element and the ground plate, and a screw which passes through the bottom plate and the ground plate to screw together the antenna module and the antenna cover.

4. The antenna apparatus according to claim 3, wherein the bottom plate is made of hard rubber.

* * * * *